US006077397A

United States Patent [19]

Shipley

[11] Patent Number: 6,077,397

[45] **Date of Patent: *Jun. 20, 2000**

[54] HIGH SUPPORT PAPERMAKERS FABRIC

[75] Inventor: Gale Shipley, Mauldin, S.C.

[73] Assignee: Asten, Inc., Charleston, S.C.

[ * ] Notice: This patent is subject to a terminal disclaimer.

[21] Appl. No.: 08/735,531

[22] Filed: Oct. 23, 1996

[51] Int. Cl.[7] ..... D12F 3/00; D03D 15/02; D03D 23/00; D03D 25/00

[52] U.S. Cl. ..... 162/358.1; 162/348; 162/DIG. 1; 139/383 A; 139/413; 139/425 A; 442/319; 442/320

[58] Field of Search ..... 139/383 A, 413, 139/425 A; 428/225, 244, 245, 257, 247, 205; 162/348, 289, 358, DIG. 1, 358.1; 442/268, 270, 319, 320

[56] References Cited

U.S. PATENT DOCUMENTS

| | | | |
|---|---|---|---|
| 4,041,989 | 8/1977 | Johansson et al. | 139/425 A |
| 4,071,050 | 1/1978 | Codorniu | 139/383 A |
| 4,093,512 | 6/1978 | Fleischer | 162/348 |
| 4,171,009 | 10/1979 | Karm | 139/425 A |
| 4,333,502 | 6/1982 | Karm | 139/425 A |
| 4,414,263 | 11/1983 | Miller et al. | 428/234 |
| 4,420,529 | 12/1983 | Westhead | 428/244 |
| 4,461,803 | 7/1984 | Booth et al. | 428/234 |
| 4,537,816 | 8/1985 | Booth et al. | 428/234 |
| 4,564,052 | 1/1986 | Borel | 139/425 A |
| 4,642,261 | 2/1987 | Fearnhead | 428/225 |
| 4,821,780 | 4/1989 | Tate | 139/383 A |
| 5,103,874 | 4/1992 | Lee | 139/383 A |
| 5,167,261 | 12/1992 | Lee | 139/383 A |
| 5,449,026 | 9/1995 | Lee | 139/383 A |
| 5,887,630 | 3/1999 | Shipley | 139/383 A |

FOREIGN PATENT DOCUMENTS

| | | |
|---|---|---|
| 0093096 | 2/1983 | European Pat. Off. . |

*Primary Examiner*—Avis M. Davenport
*Attorney, Agent, or Firm*—Volpe and Koenig, P.C.

[57] ABSTRACT

A woven papermakers fabric having a first system of yarns interwoven with a second system of yarns. The second system of yarns having a repeat which defines three successive knuckles on the paper carrying side of the fabric while maintaining vertical alignment of the first system yarns in the respective first and second layers of the first system by defining a single knuckle on the machine side of the fabric in each repeat. Preferably, the first system yarns are cross machine direction (CMD) yarns which repeat with respect to eight pairs of stacked machine direction (MD) yarns.

17 Claims, 3 Drawing Sheets

HIGH SUPPORT PAPERMAKERS FABRIC

BACKGROUND OF THE INVENTION

1. Field of the Invention

The present invention relates to papermakers fabric. More particularly, the present invention relates to the weave construction of forming fabrics and press felts.

2. Description of the Prior Art

Papermaking machines transform an aqueous slurry of pulp fibers into a continuous paper sheet. The papermaking process starts in a forming section of the papermaking machine where an aqueous pulp slurry is deposited onto forming fabrics having desired characteristics for retaining the pulp fibers while allowing water to pass through the fabric. In the forming section, the pulp fibers are formed into an aqueous paper web. The paper web is then transferred to and carried by press felts through a press section of the papermaking machine where additional water is removed by conveying the paper web through one or more press nips. The paper web is then transferred to and carried through a drying section on dryer fabrics to remove additional water through forced evaporation. The designs of papermakers fabrics used on each section of the papermaking machine vary in accordance with function.

Forming fabrics may possess fine mesh weave to support the paper fibers in the slurry. Additionally, a fine weave avoids paper markings on the forming paper. Forming fabrics should also possess good drainage characteristics to facilitate paper formation during the initial water removal from the slurry. Furthermore, the forming fabric should withstand tensile loads in the machine direction and compressive buckling loads in the cross machine direction.

For press felts, several other characteristics are desired. Press felts should maintain sufficient void volume to allow the efficient transfer of water out of the aqueous paper web as it is conveyed through press nips. The press felts should be designed to withstand the humidity and temperature rigors of the press section. Furthermore, the felts should maintain uniformity over a substantial time period as they are used on the press section. In light of these conditions and factors, it is desired to provide press felts with enhanced stability, low flow resistance, compaction resistance, increased void volume, increased cleanability, and durable pressing uniformity.

Attempts have been made to overcome the problems associated with forming fabrics and press felts. For example, U.S. Pat. No. 4,041,989 (Johansson et al.); U.S. Pat. No. 4,642,261 (Fearnhead); U.S. Pat. No. 4,071,050 (Codonik); and U.S. Pat. No. 4,564,052 (Borel) disclose two-layer fabrics having various weave repeats. While these patents disclose fabrics which perform satisfactorily in many applications, it is desirable to provide a structure for forming fabrics and press felts, having improved paper carrying support while maintaining the overall void volume and open area of the fabric.

SUMMARY OF THE INVENTION

The present invention provides a papermakers fabric having two layers of machine direction (MD) yarns interwoven with a system of cross machine direction (CMD) yarns. The weave repeat of the CMD yarns includes three adjacent knuckles on the paper carrying side of the fabric to enhance fiber support and an acute v-type pattern forming a single knuckle on the machine side of the fabric to maintain the MD yarns in a stacked relationship.

In forming fabrics, the weave of the present invention allows for the important characteristic of straight through drainage. Additionally, important in forming fabrics, the weave provides enhanced CMD yarn support which enhances sheet formation. The fabric construction also allows for stacking while preventing twinning.

In press felts, several advantages are provided by the weave construction of the present invention. The fabric weave pattern enhances the stability of the felt. This construction in press felts permits low flow resistance which allows for greater ease in water removal from the aqueous paper web. Compaction resistance of the press felts is enhanced. The weave increases the void volume and cleanability of the press felts. Additionally, durable pressing uniformity is imparted to the press felts with this construction.

Additional objects and advantages of the present invention will be apparent from the detailed description which follows.

DESCRIPTION OF THE PREFERRED EMBODIMENT

Those skilled in the art will recognize that papermakers fabrics may either be flat woven and seamed or endless woven to produce what is effectively an endless belt. As used herein, the woven yarns are referred to according to their respective orientation on the papermaking machine as either machine direction (MD) yarns or cross machine direction (CMD) yarns. Machine direction extends in the direction of travel on the papermaking machine and cross machine direction extends transverse to the direction of travel of the fabric on the papermaking machine.

Figure 1:
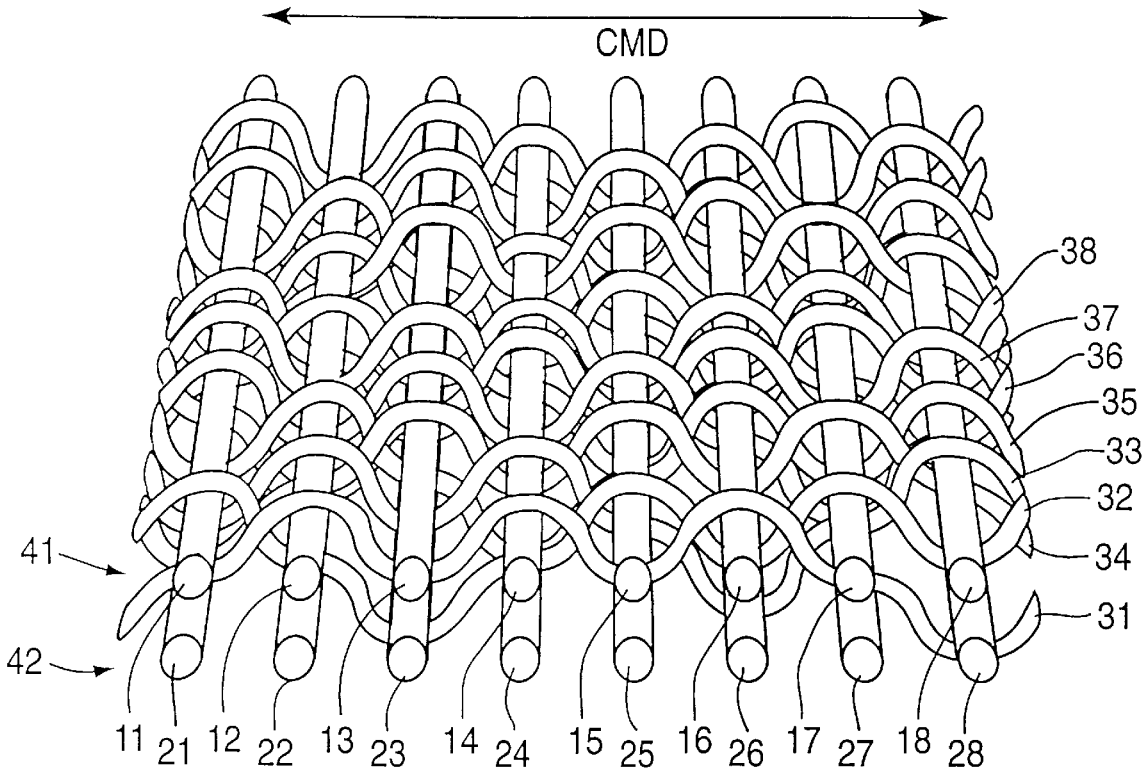
FIG. 1 is a perspective view of a fabric constructed in accordance with the teachings of the present invention.
Figure 2:
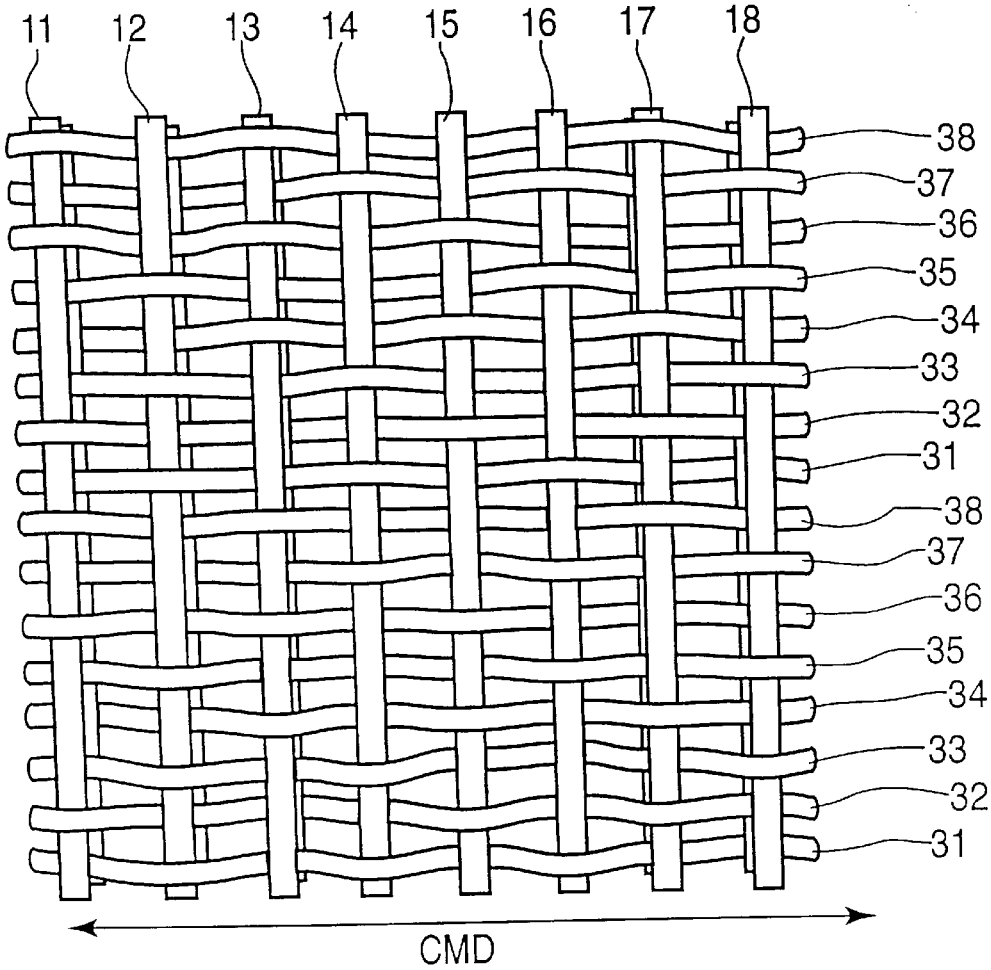
FIG. 2 is a top view of the fabric shown in FIG. 1.

With reference to FIGS. 1–3, there is shown a papermakers fabric 10 comprised of a system of MD yarns interwoven with a system of CMD yarns in a select repeat pattern. The MD yarns are arranged in two layers 41, 42. The top or upper MD layer 41 is on the side of the fabric which carries the aqueous paper web. The bottom or lower MD layer 42 is on the side of the fabric which is in contact with the papermaking machine. The yarns 11–18 and 21–28 of the respective MD layers 41, 42 are vertically aligned in stacked pairs, 11 and 21, 12 and 22, etc.

The weave pattern of the fabric 10 repeats with respect to eight stacked pairs of MD yarns 11–18 and 21–28 and eight CMD yarns 31–38. Each of the CMD yarns in the repeat forms three successive knuckles on the paper carrying side of the fabric by sequentially weaving over and under five upper layer MD yarns in succession. After forming the third knuckle, each CMD yarn passes between a pair of stacked upper and lower MD yarns, under the next lower layer MD yarn to form a machine side knuckle, between the next pair of upper and lower MD yarns and then continues to form three successive paper side knuckles with respect to the next five upper layer MD yarns. For example, CMD yarn 31 forms three successive knuckles over top MD layer yarns 12, 14, 16 by passing over top layer MD yarn 12, between top layer MD yarn 13 and bottom layer MD yarn 23, over top layer MD yarn 14, between top layer MD yarn 15 and bottom layer MD yarn 25, and over top layer MD yarn 16. CMD yarn 31 completes its repeat by weaving between top layer MD yarn 17 and bottom layer MD yarn 27, under bottom layer MD yarn 28 to form a machine side knuckle and between MD yarns 11 and 21.

When the CMD yarns descend from weaving the three successive knuckles over the upper layer MD yarns to weave, between a stacked pair of upper and lower MD yarns, under a lower layer MD yarn and between the next stacked pair of upper and lower MD yarns to then return to weave the next three successive knuckles on upper layer MD yarns, a v-shaped pattern is formed. The v-shaped pattern formed between the three successive knuckle groups maintains vertical stacking of the respective upper MD yarns 11–18 with the lower MD yarns 21–28 of the MD yarns 41, 42.

As best seen in FIGS. 3*a*–3*h*, the three successive knuckles defined by each CMD yarn 31–38 are shifted a distance of three upper layer MD yarns with respect to each successive CMD yarn in the repeat. Accordingly, the first CMD yarn 31 in the repeat forms three successive knuckles over upper layer MD yarns 12, 14, 16. The second CMD yarn 32 in the repeat forms three successive knuckles over upper layer MD yarns 15, 17, 11. The third CMD yarn 33 in the repeat forms three successive knuckles over upper layer MD yarns 18, 12, 14. The fourth CMD yarn 34 in the repeat forms three successive knuckles over upper layer MD yarns 13, 15, 17. The fifth CMD yarn 35 in the repeat forms three successive knuckles over upper layer MD yarn 16, 18, 12. The sixth CMD yarn 36 in the repeat forms three successive knuckles over upper layer MD yarns 11, 13, 15. The seventh CMD yarn 37 in the repeat forms three successive knuckles over upper layer MD yarns 14, 16, 18. The eighth and final CMD yarn 38 of the repeat forms three successive knuckles over upper layer MD yarns 17, 11, 13. This weave pattern enhances CMD support for the paper carrying side of the fabric while allowing straight through drainage by maintaining stacking of the MD yarns.

Figure 4:
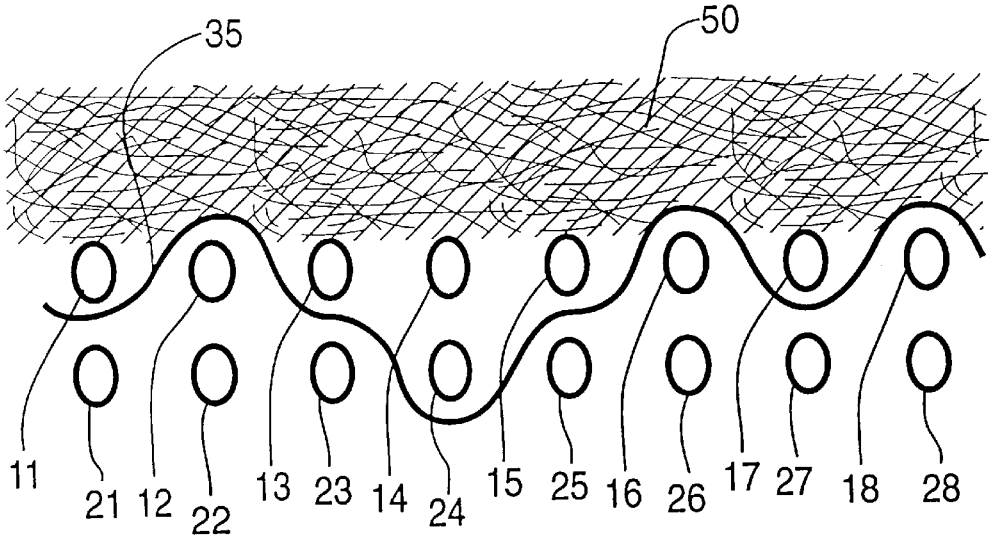
FIG. 4 is a schematic view of the fabric as shown in FIG. 3*e* combined with batt needled on one side of the fabric to form a press felt.
Figure 3A:
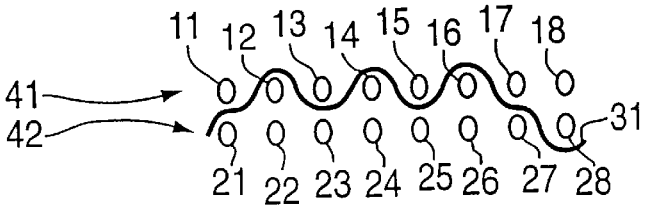
FIGS. 3*a–h* is a sequence of schematic views representing the successive CMD yarns in the weave repeat of the fabric shown in FIG. 1.
Figure 3B:
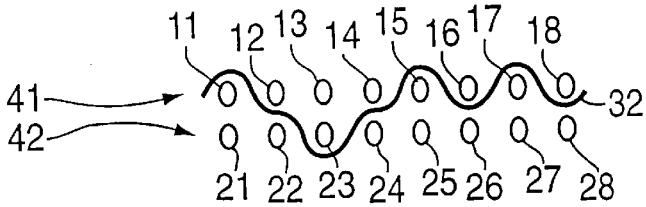
Figure 3C:
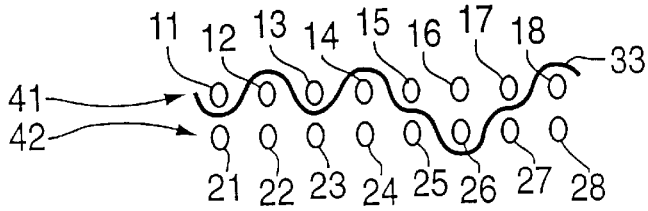
Figure 3D:
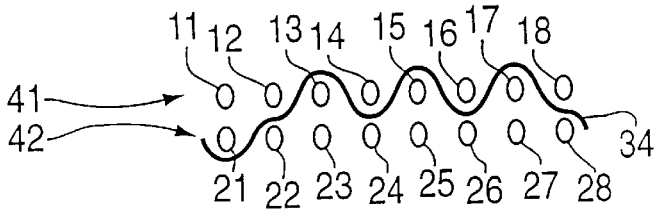
Figure 3E:
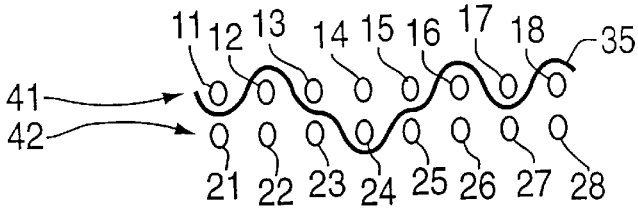
Figure 3F:
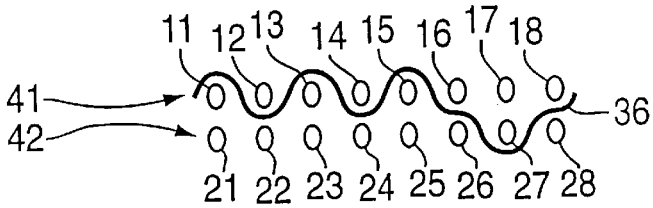
Figure 3G:
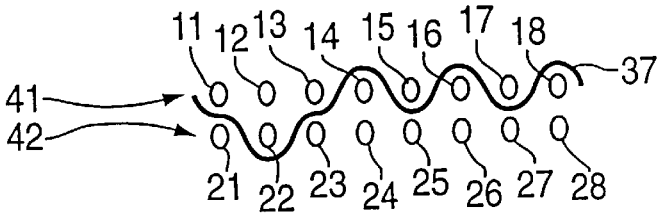
Figure 3H:
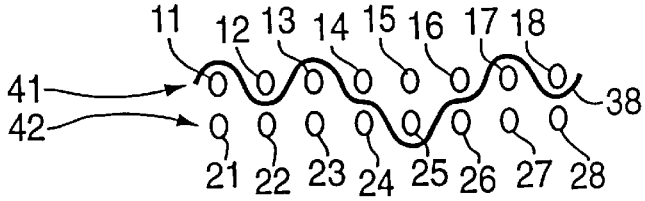

Preferably, the fabric is endless woven. When the fabric 10 is used as a base fabric for a press felt, the MD yarns are preferably 0.008"/2/2 cabled monofilament nylon yarns or single monofilament nylon yarns having a diameter of 0.010"–0.020" woven 20–40 yarns per inch. The CMD yarns are preferably monofilament yarns 0.008"–0.020" in diameter woven at 20–40 yarns per inch. Alternatively, the CMD yarns may be cabled yarns ranging from 0.008"/2/2 to 0.003"/15/3 in size or multifilament or spun yarns of 420–1260 denier. The CMD yarns are preferably made of nylon, but can be acrylic, polyethlyene terephthalate (PET), polypropylene, polyetheretherketone (PEEK), polyvinyl alcohol (PVA) or combinations thereof. To finish the press felt, preferably batting material 50 as illustrated in FIG. 4, is needled onto one or both sides of the base fabric 10. The amount of batting is preferably roughly equal to the weight of the base fabric such that the weight of the batting ranges from 35–65% of the weight of the finished press felt.

When the fabric 10 is intended for use as a forming fabric no batting is used. The MD yarns are preferably woven 30–400 yarns per inch and the CMD yarns are 20–220 yarns per inch from monofilament yarns having a diameter of 0.0035"–0.035". Yarn sizes are varied dependent upon the paper product which is to be made to produce, for example, a fine paper fabric.

Other variations within the scope and spirit of the invention will be apparent to those of ordinary skill in the art. Although the invention has been described in part by making detailed references to the preferred embodiment, such detail is intended to be instructive rather than restrictive. It will be appreciated by those skilled in the art that many variations may be made in the structure and mode of operation without departing from the spirit and scope of the invention as disclosed in the teachings herein.

I claim:

1. A papermakers fabric having a paper carrying side and a machine side comprising:

a system of MD yarns having an upper layer of MD yarns on the paper carrying side of the fabric and a lower layer of MD yarns on the machine side of the fabric;

said system of MD yarns interwoven in a selected repeat pattern with a system of CMD yarns such that said CMD yarns maintain the MD yarns of said upper layer in a stacked relationship with respect to the MD yarns of said lower layer; and each CMD yarn of the CMD yarn system repeat pattern weaving with upper layer MD yarns to define three successive knuckles on the paper carrying side of the fabric and under a single lower layer MD yarn to define a single knuckle on the machine side of the fabric within each repeat.

2. A wet press felt comprising a base fabric according to claim 1 and batt material needled to said base fabric such that the batt material is 35–65% of the weight of the press felt.

3. A wet press felt according to claim 2 wherein the MD yarns are woven from 20 to 40 yarns per inch and the CMD yarns are woven from 30 to 70 yarns per inch.

4. A wet press felt according to claim 2 wherein the MD yarns are 0.008"/2/2 cabled monofilament nylon.

5. A wet press felt according to claim 2 wherein the MD yarns are single monofilament yarns having a diameter of 0.010 inches to 0.020 inches.

6. A wet press felt according to claim 2 wherein the CMD yarns are made of a material selected from the group consisting of nylon, acrylic, polyethlyene terephthalate, polypropylene, polyetheretherketone, polyvinyl alcohol, and combinations thereof.

7. A forming fabric comprising a papermakers fabric according to claim 1 wherein the MD yarns are woven from 30 to 400 yarns per inch, the CMD yarns are woven from 20 to 200 yarns per inch, the yarns having a diameter in the range of 0.0035 inches to 0.035 inches.

8. A papermakers fabric according to claim 1 wherein said repeat pattern is on eight CMD yarns and eight stacked pairs of upper and lower layer MD yarns.

9. A papermakers fabric according to claim 8 wherein the three successive paper carrying side knuckles defined by each CMD yarn are shifted a distance of three upper layer MD yarns with respect to each successive CMD yarn in the repeat.

10. A wet press felt comprising a base fabric according to claim 9 and batt material needled to said base fabric such that the batt material is 35–65% of the weight of the press felt.

11. A wet press felt according to claim 10 wherein the MD yarns are woven from 20 to 40 yarns per inch and the CMD yarns are woven from 30 to 70 yarns per inch.

12. A wet press felt according to claim 10 wherein the MD yarns are 0.008"/2/2 cabled monofilament nylon.

13. A wet press felt according to claim 10 wherein the MD yarns are single monofilament yarns having a diameter of 0.010 inches to 0.020 inches.

14. A wet press felt according to claim 10 wherein the CMD yarns are made of a material selected from the group consisting of nylon, acrylic, polyethlyene terephthalate, polypropylene, polyetheretherketone, polyvinyl alcohol, and combinations thereof.

15. A forming fabric comprising a papermakers fabric according to claim 9, wherein the MD yarns are woven from about 30 to about 400 yarns per inch, the CMD yarns are woven from about 20 to about 200 yarns per inch, the yarns having a diameter of from about 0.0035 inches to about 0.035 inches.

16. A papermakers fabric having a paper carrying side and a machine side comprising:

a first system of yarns having an upper layer of yarns on the paper carrying side of the fabric and a lower layer of yarns on the machine side of the fabric;

said first system of yarns interwoven in a selected repeat pattern with a second system of yarns such that said second system of yarns maintains upper layer first system yarns in a stacked relationship to the lower layer first system yarns; and each yarn of said second yarn system repeat pattern weaving with upper layer first system yarns to define three successive knuckles on the paper carrying side of the fabric and under a single lower layer first system yarn to define a single knuckle on the machine side of the fabric within each repeat.

17. A papermakers fabric according to claim 16 wherein said first system yarns are MD yarns and said second system yarns are CMD yarns.

* * * * *